US009514721B1

(12) United States Patent
Champion

(10) Patent No.: US 9,514,721 B1
(45) Date of Patent: Dec. 6, 2016

(54) ERGONOMIC GUITAR SUPPORT FOR ACOUSTIC GUITAR

(71) Applicant: Brent William Champion, Kalispell, MT (US)

(72) Inventor: Brent William Champion, Kalispell, MT (US)

( * ) Notice: Subject to any disclaimer, the term of this patent is extended or adjusted under 35 U.S.C. 154(b) by 0 days.

(21) Appl. No.: 15/187,734

(22) Filed: Jun. 20, 2016

(51) Int. Cl.
*G10G 5/00* (2006.01)

(52) U.S. Cl.
CPC ..... *G10G 5/005* (2013.01)

(58) Field of Classification Search
CPC ..... G10G 5/005
See application file for complete search history.

(56) References Cited

U.S. PATENT DOCUMENTS

| | | | | |
|---|---|---|---|---|
| 1,272,583 | A | 7/1918 | Vrubel | |
| 3,979,993 | A | 9/1976 | Proctor | |
| 4,592,265 | A | 6/1986 | Steinberger | |
| 4,966,062 | A | 10/1990 | Driggers et al. | |
| 5,202,527 | A * | 4/1993 | Gracie | F16M 11/28 84/327 |
| 5,388,492 | A | 2/1995 | Olson | |
| 5,616,874 | A | 4/1997 | Kraus et al. | |
| D410,669 | S | 6/1999 | Hamre | |
| 6,031,167 | A | 2/2000 | Gaston | |
| 6,252,150 | B1 | 6/2001 | Johnson | |
| 6,576,823 | B1 | 6/2003 | Wise, Jr. | |
| 6,683,237 | B2 | 1/2004 | Christou | |
| 7,205,468 | B1 | 4/2007 | Johnson | |
| 7,531,728 | B2 * | 5/2009 | Nguyen | G10D 1/085 84/291 |
| 7,732,689 | B1 | 6/2010 | Jiang et al. | |
| 8,188,354 | B2 * | 5/2012 | Mercer | G10G 5/005 84/327 |
| 8,455,744 | B2 | 6/2013 | Barnett | |
| 8,530,733 | B2 | 9/2013 | Bibb | |
| 8,901,403 | B2 | 12/2014 | Barnett | |
| 2008/0196572 | A1 | 8/2008 | Navarro | |
| 2010/0313731 | A1 * | 12/2010 | Markakis | G10G 5/005 84/327 |
| 2015/0053061 | A1 | 2/2015 | Coglitore | |

FOREIGN PATENT DOCUMENTS

| | | | |
|---|---|---|---|
| DE | 19725157 A1 * | 1/1999 | G10G 5/005 |
| DE | 19725157 C2 | 4/2002 | |

(Continued)

*Primary Examiner* — Robert W Horn
(74) *Attorney, Agent, or Firm* — Sarah J. Rhoades

(57) ABSTRACT

A guitar support device permits ergonomic use of a guitar by a seated user, without attachment of any damaging hardware to the instrument. The guitar rest receives the lower and upper bouts of a guitar body with a complementary shaped frame. Stabilizer mounts abutting the guitar face and at least one stop abutting the guitar's back secure the device. The ergonomic support securely cradles the guitar so that the user may move around to better play or to relieve pressure points. The weight of the guitar is distributed over the user's leg and supported by a toe that descends vertically between the user's legs and abuts the surface upon which the user sits. The device is hinged to allow it to fold and skeletally framed to reduce weight and create a carrying handle, both of which make it easily transportable and storable.

21 Claims, 15 Drawing Sheets

(56) References Cited

FOREIGN PATENT DOCUMENTS

| | | | | | |
|---|---|---|---|---|---|
| DE | 20300431 | U1 * | 3/2003 | ..... | G10G 5/005 |
| DE | EP 1895504 | A1 * | 3/2008 | ..... | G10G 5/005 |
| GB | WO 9807139 | A1 * | 2/1998 | ..... | G10G 5/005 |
| WO | 9807139 | | 2/1998 | | |
| WO | 2014030012 | A1 | 2/2014 | | |
| WO | WO 2014030012 | A1 * | 2/2014 | ..... | G10G 5/005 |

* cited by examiner

ERGONOMIC GUITAR SUPPORT FOR ACOUSTIC GUITAR

Brent William Champion, a citizen of the United States of America residing in Kalispell, Mont. has invented a new, useful and non-obvious Ergonomic Guitar Support for Acoustic Guitar.

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

This invention relates to a guitar support device, and more particularly to such a device which supports an acoustic guitar when a user is seated, the device having contact points on the user and the chair to support and position the guitar ergonomically.

2. Description of the Related Art

Most Seated Guitar supports require the use of material to attach the support to the guitar or the user. These materials include magnets, suction cups, and straps. These methods of attachment can be difficult to attach, as in Barnett (U.S. Pat. No. 8,455,744 B2) where the magnets need to be strategically placed within the guitar body and the support attaches to the guitar from the outside of the guitar body. The magnet must have great strength to pass through the guitar body and hold together which can result in damage to the guitar body and/or finish.

Meanwhile, Driggers et al. (U.S. Pat. No. 4,966,062), uses suction cups which are difficult to keep hold of the guitar body unless they are moistened; they can damage the finish quite easily as products on the market caution to use only on a clean guitar body with a well cured finish.

Straps often are placed around a leg, waist, and/or neck for stability and can take time, be difficult to put on, and may be uncomfortable. Many of the supports offer adjustments for height requiring the user to continually loosen and tighten bolts, pins and straps. These items are cumbersome and can be difficult to adjust. They also give some support, but may not be strong enough to keep the guitar in place without the user having to repeatedly adjust the support on the thigh as he moves around while playing and, as the user moves around, the supports with many adjustable parts can be noisy and even squeak when the user moves in rhythm with his playing.

The supports of previous inventions are not able to adjust the guitar's neck elevation while in use. This is a deterrent to the user. Musicians require flexibility during a performance or even a single song to allow for variation in neck elevation positioning. Small movements can have a significant impact on playing accuracy and make big differences to performers, students, and teachers.

The industry needs a seated guitar support that can easily be set up and holds the guitar in an ergonomic position as to not strain the user's back, neck or wrist. Such a device with stability and reliability is needed. Continual adjustment is not desirable. The risk of possibly stripping a bolt or nut must be avoided. Musicians also demand a device that is visually appealing and complements a guitar, not detract from it. Any accessory must not damage the instrument in any way.

BRIEF SUMMARY OF THE INVENTION

The present invention is a new device for supporting a guitar in an ergonomic position. The device may be used with an instrument with an upper-bout and a lower-bout. The device comprises a toe, a lower-bout receiving support frame hingedly affixed to the toe at the junction of the leg rest and the upper-bout receiving face, and at least one guitar bracket. The toe includes an upper-bout receiving face, a vertically descending structure, a chair abutment knuckle, and a leg rest. The upper-bout receiving face is adjacent to the vertically descending structure, which structure meets the leg rest at the chair abutment knuckle. The upper-bout receiving face has a proximal projection, or stop, to work in concert with the bracket in order to press and hold the guitar by a friction fit. The lower-bout receiving support frame has a lower-bout receiving face shaped in a curve to receive the lower-bout of a guitar. The receiving face has a proximal projection to work in concert with another bracket to hold the guitar. The brackets, preferably two of them, are adjustably adjoined to the toe and the lower-bout receiving support frame, respectively, by screws, knobs, hex drive wood inserts, or the like. The brackets press fit the guitar against the proximal projections. During use the guitar body rests on the upper-bout receiving face and the lower-bout receiving face.

In commerce, the preferred embodiment of the ergonomic guitar support, may be branded as a "Guitar Shoe" because its shape arbitrarily resembles a high heel shoe. The connection of the device to the guitar does not require any straps, suction cups or magnets but is accomplished by a gentle yet secure press fit between opposing components of the invention. It is a full body guitar support device that stabilizes the guitar and holds it in a comfortable, ergonomic position ideal for optimal playing. Putting the invention into use does not require much set up time. Its unitary construction doesn't introduce any object that could damage the guitar finish. Its resting design does not require the use of straps to tie the user to the support or to the guitar. The unique attributes of the preferred embodiment make the invention visually appealing, while in use or if stored in a music room. It automatically adjusts for each user simply by moving the ergonomic guitar support on the thigh until the most comfortable position is attained—without the need for any adjustment mechanisms. The arch of the leg rest makes the device useable by musicians of all sizes. There are virtually no moving parts so there is no chance that the support, or the guitar sitting in the support, will make any sort of sound or squeak during use, which is particularly important in noise-sensitive music environments like recording studios.

The ergonomic guitar support has two means of support: one is the leg thigh rest and the other is the chair abutment knuckle. Existing patents and devices on the market totally rely on the leg thigh support only or leg support and body straps. This device has two contact points for support. This is one reason it works so well and is very comfortable. Two contact points are preferred over one contact point because over long periods of playing or practice a pressure point can be created by the isolated nature of a single contact point on a user's leg.

The inventor created the invention after about four decades of playing guitar. Frustration and fatigue combated the inventor's progress and so he sought out solutions to aid in proper guitar-holding techniques. Having found none, the inventor conceived and reduced to practice a guitar rest device without any attachments that can damage the guitar, or any adjustable user attachments, which can be cumbersome and uncomfortable.

The present invention is a visually appealing, folding guitar support that aids the player when in a seated position to play guitar for long periods of time without back, neck or wrist strain. The full size frame of the present invention maintains stability of the guitar while in use and prevents the guitar from traveling back and forth on the device when it is being played. Yet, the device is not attached to the guitar or the user's body, it is only held by an interference fit. The guitar support will not affect the sound produced by the instrument.

To use the device, the user sits down, pulls the latch back (on the folded ergonomic guitar support) and opens the device, sets the device on his right thigh (for a right-handed player), loosens the knobs of the stabilizer mounts, places the guitar onto the top of the device, and adjusts the mounts in or out until the mounts just touch the outside edge of the guitar, tightens the knobs that secure the mounts, and prepares to play the instrument. The user is able to comfortably hold and maintain proper positioning of the guitar while playing and is able to maneuver through guitar neck elevation changes on the fly.

The main frame of the present invention is unique and nonobvious. It is shaped to accept an acoustic guitar and to fit on the user's thigh using no attachments or straps. It is designed to allow the user to comfortably play guitar in a seated position for long periods of time since the guitar support holds the guitar in the correct playing position with no effort. The knuckle portion of the guitar support (located near the inner thigh of the user) stabilizes the guitar so the guitar neck does not dip too low and cause wrist strain. The point of contact between the knuckle and the chair helps the user keep his/her back straight, alleviating back strain. The full frame under the guitar keeps it from shifting back and forth while being played; it makes it feel like you are one with the guitar and the guitar support. A user can move around pretty radically in the chair while playing, swinging to the music, tapping a foot, etc. Even though the guitar is not attached in any way to the guitar support or the user, the invention features help the guitar stay with the user at all times. The device will further enhance fretting hand flexibility because it keeps the neck at the two o'clock position. It prevents position fatigue which generally results in the neck falling to the three or four o'clock positions.

The latch assembly of the present invention is also unique and nonobvious. This totally custom component was created specifically for the present invention. The latch assembly permits quick locking and unlocking, gives protection to the folding hinge, and swings out of the way when the support is unfolded and in use. The edge mounts are also totally custom components for the invention.

The ergonomic guitar support is uniquely constructed to be aesthetically pleasing to the eye. This is important because a guitar support should not distract from the guitar, considered a work of art to many guitar players. It folds up to be half its size for travel or storage.

The biggest disadvantage to a guitar player, beginner or not, is that they are not able to play the guitar in a seated position for long periods of time without any kind of physical strain to the back, neck and/or wrist. The beginner player may lose interest because to practice for any length of time becomes uncomfortable and distracts the individual from being able to concentrate on the skills they are trying to learn. Meanwhile, a player with many years of experience may break down his body over time. The back, neck and wrist strain can distract the player, forcing him to change positions or even to stand. A player needs to be able to make adjustments so he can continue to play. With the present invention, the user only has to unfold the device, place the guitar into it, tighten the guitar mounts and begin to play. There are no straps or attachments to set up; nothing needs to be affixed to the guitar which could damage the finish or magnets that need to be carefully placed and adjusted each time it is used. The present invention folds into travel or storage mode very easily. The device mounts can be pushed in to narrow the width of the support for travel, then tightened using the rod retainer screw knobs. The user then folds the device and fastens the latch to the latch receiver and is ready to go. The invention is attractive and lightweight in design, but sturdy to support heavy user leaning. The invention does not detract from the guitar's look or finish.

More specifically, and in a presently preferred embodiment, by way of example and not necessarily by way of limitation, the device is described as being used with a guitar. Guitar is meant to include any lap-held musical instrument with an upper bout, but specifically includes a lap-held, stringed, acoustic instrument, with an upper-bout and a lower-bout. The device could service any lap-held musical instrument with at least one bout. Preferably the musical instrument will have a flat back to abut the stops and a flat front to abut the stabilizer mounts.

The foregoing has outlined, in general, the physical aspects of the invention and is to serve as an aid to better understanding the more complete detailed description which is to follow. In reference to such, there is to be a clear understanding that the present invention is not limited to the method or detail of construction, fabrication, material, or application of use described and illustrated herein. Any other variation of fabrication, use, or application should be considered apparent as an alternative embodiment of the present invention.

BRIEF DESCRIPTION OF THE DRAWINGS

The following drawings further describe by illustration, the advantages and objects of the present invention. Each drawing is referenced by corresponding figure reference characters within the "DETAILED DESCRIPTION OF THE INVENTION" section to follow.

DETAILED DESCRIPTION OF THE INVENTION

Figure 1:
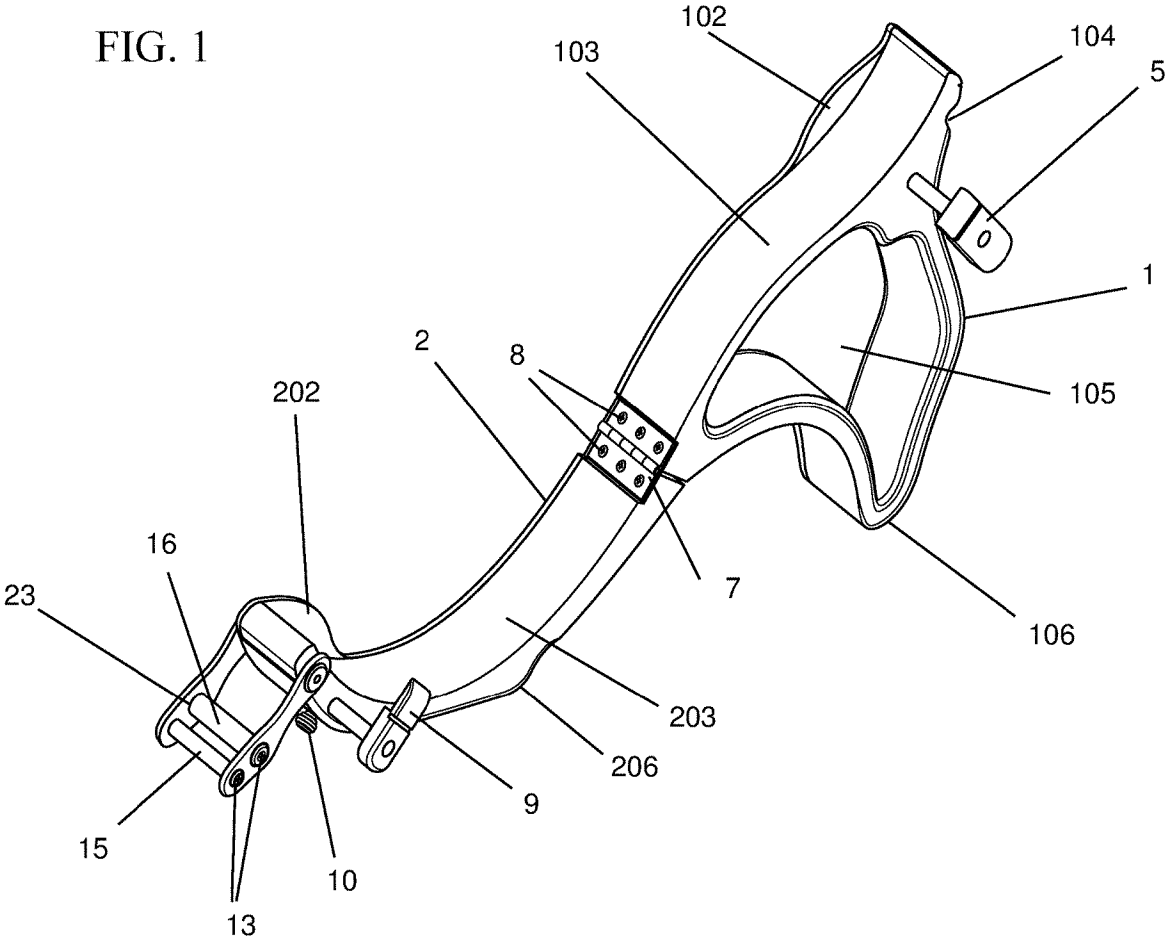
FIG. 1 is a perspective view of the Ergonomic Guitar Support in an open or unfolded position, ready for receiving a guitar.

The top perspective view of FIG. 1 illustrates the major components of the present invention when it is an unfolded orientation and ready for the addition of a guitar. The toe 1 and the lower-bout receiving frame 2 are adjoined by the hinge 7. The receiving faces 103, 203 are ready to receive a guitar which will abut the two backer tab stops 102, 202. The toe stabilizer mount 5 and the lower frame stabilizer mount 9 are pulled away from the support. In the preferred embodiment, the guitar stabilizer edge mounts 5, 9 are turned up to catch the outside edge of guitar. In FIG. 1, the latch assembly 23 is shown in the open position. The latch assembly 23 comprises a latch handle 15, latch roller 16, latch sides 19, 24 and connecting hardware 12, 13, 14, 17, 18, 20 and 25 and shown in FIGS. 10 and 15.

Figure 10:
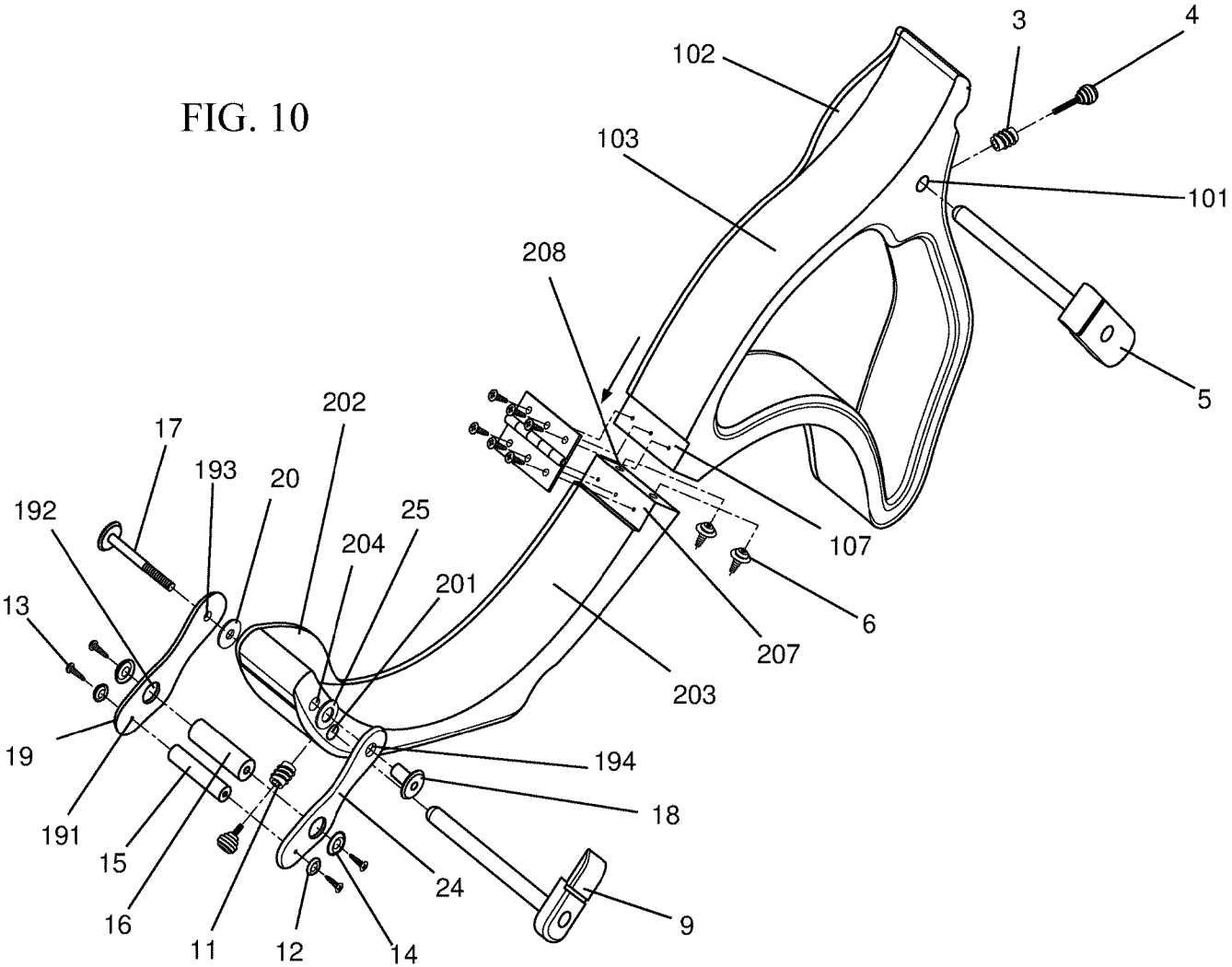
FIG. 10 is an exploded perspective view of the invention.

The backer plate tabs, called stops 102, 202, are readily visible in FIGS. 1 and 10. These stops are flat protrusions on the proximal, top edge of the lower-receiving face 203 and the upper-bout receiving face 103. The stops 102, 202 provide a surface against which the stabilizer mounts 5, 9 may press the guitar to secure it in the device. The lower back surface of a guitar 22 (shown in FIG. 11, FIG. 12, FIG. 13 and FIG. 14) is pressed against the stops 102, 202 during use.

Figure 2:
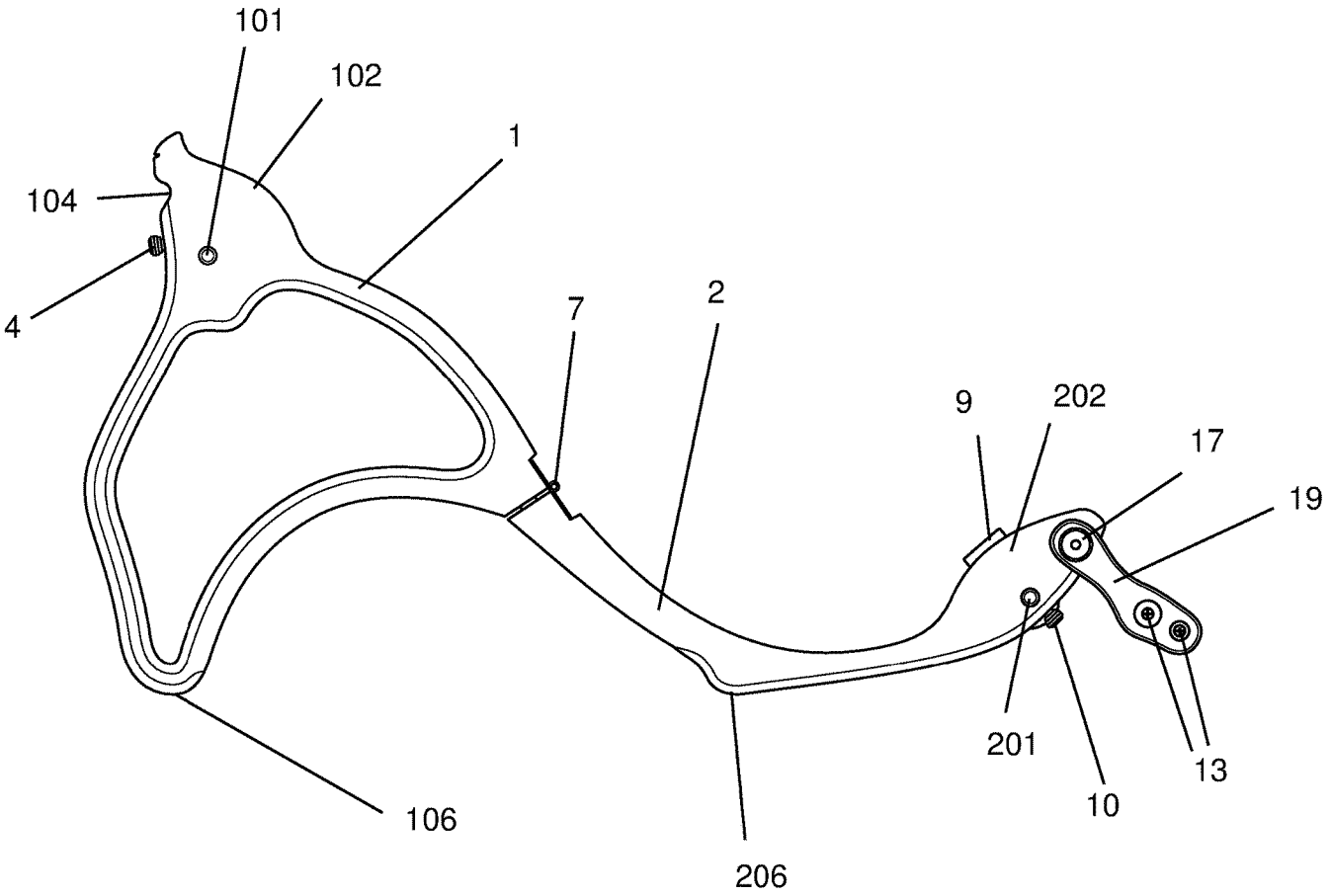
FIG. 2 is a back view of the invention in an open or unfolded position shown in FIG. 1.

The back side of the preferred embodiment of the present invention, when opened for use, is illustrated in FIG. 2. A slightly different shape is shown because of the backer plate stops 102, 202 are part of the frame 1, 2. FIG. 2 also shows rod retainer screw knobs 4, 10. The holes 101, 201 illustrated in this back view are the locations where the stabilizer rods 5, 9 push through to the backside of device frame 1, 2 when it is folded up in travel mode.

Figure 3:
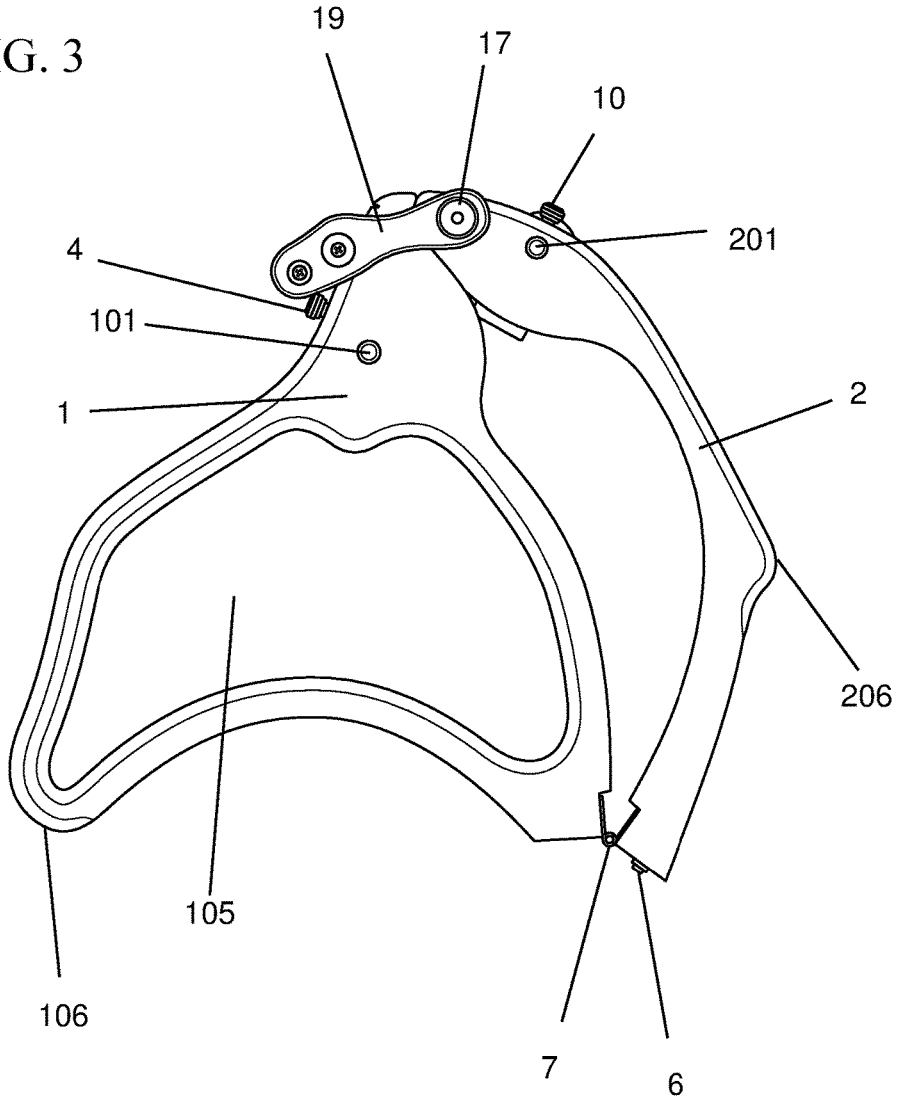
FIG. 3 is a back view of the invention in a closed or folded position.

FIG. 3 shows the back side of a preferred embodiment of the present invention in travel mode, in other words, when folded for easy transport. FIGS. 3-7 illustrate the latch assembly 23 in a closed position. Again, the rod retainer screw knobs 4, 10 are shown. The holes 101, 201 for stabilizer rod 5, 9 ends to come out. FIG. 3 also shows the hinge 7 folded, and exposes the hinge gap filler inserts 6, in this case the adjustment screw heads.

Figure 4:
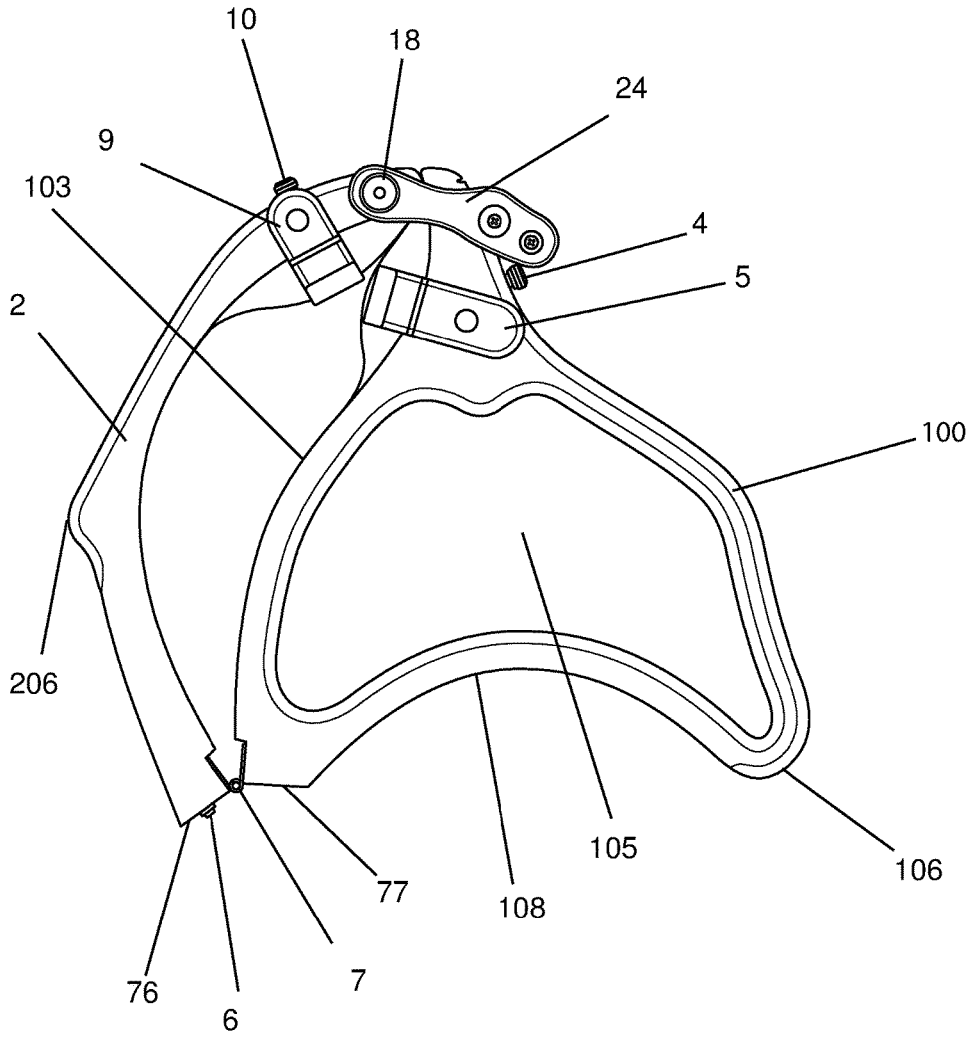
FIG. 4 is a front view of the invention in a closed or folded position.

Turning to FIG. 4, the front view of the device in a folded position is shown. Stabilizer Rods 5, 9 are pushed in. The latch assembly 23 is engaged to hold the device in a locked, closed position for storage mode. The hinge 7 and the gap filler inserts 6 are once again visible.

FIGS. 3 and 4 emphasize the shape of the toe 1 and particularly the cutout or void 105 of the toe 1 of the preferred embodiment of the present invention. The upper-bout receiving face 103 is adjacent to the vertically descending structure 100, the vertically descending structure 100 meets the leg rest 108 as the chair abutment knuckle 106. The position of device would need to be horizontally flipped with the stop tabs 102, 202 transferred to the opposite side and the mounts would be received through the opposite side for use by a left-handed player. However, FIGS. 1-14 illustrate the preferred embodiment in a configuration particularly suited to a right-handed player. In FIG. 4, the knuckle 106 is located in the lower right corner while the small heel 206 is located at the left side of the drawing. The small heel 206 located on the far left side looks like a bump-out. In the rear view of a right-handed configuration show in FIG. 3, the knuckle 106 is located at the lower left of the drawing while the small heel 206 is located at the right.

The knuckle 106 abuts the surface upon which the user is sitting, but allows the user to pivot the guitar support and therefore the guitar while playing. The knuckle 106 absorbs a good deal of the weight of the guitar and relieves excessive pressure on the user's body. When in use, the guitar support also only allows the neck of the guitar to dip so far. The small heel 206 is used as a stabilizer base for when the support is not being used and is sitting on a flat surface not in the folded position. It keeps the support frame from inadvertently folding back up while not being used.

Figure 5:
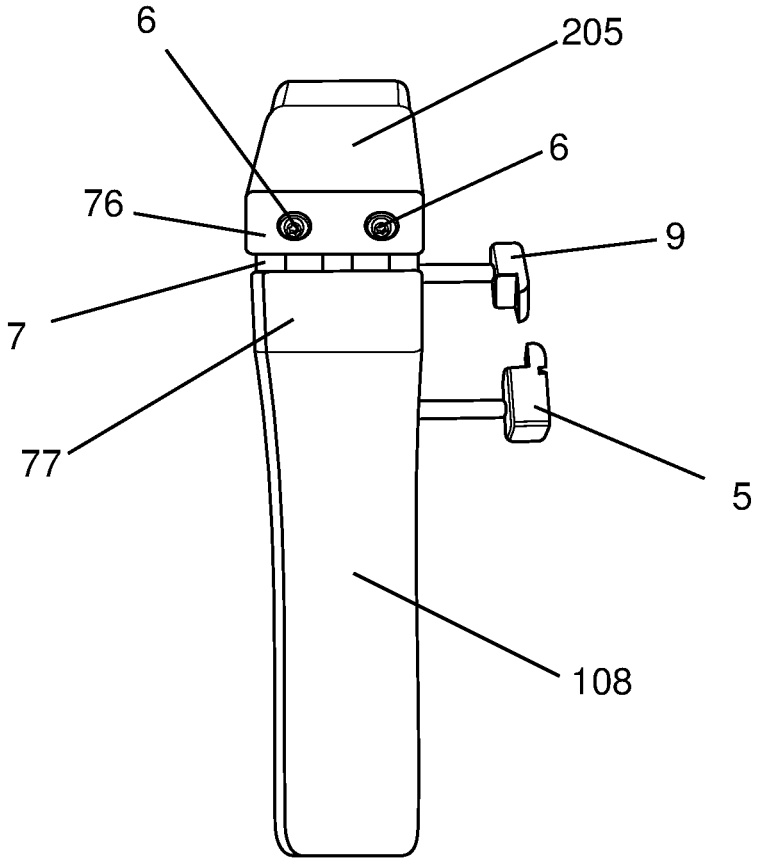
FIG. 5 is a bottom view of the invention in a closed or folded position.

FIG. 5 is a bottom view of the present invention when folded. The gap adjustment screws 6 are shown in the center hinge area. These gap fillers 6 are needed as the guitar support wears over time. The gap fillers 6 will allow adjustment to slight variations in guitars, since no two guitars are exactly the same size. The gap fillers can be adjusted to change the spacing and raise or lower the lower-bout support frame 2 of the guitar support to properly fit the guitar body for front and back movement. The hinge 7 is adjustable to varying opening angles by adjustment screws narrowing an angle of abutment between a first hinge face 76 and a second hinge face 77. In FIG. 5, the stabilizer mounts 5, 9 are extended away from the frame. FIG. 5 further shows the leg rest edges 108, 205.

Figure 6:
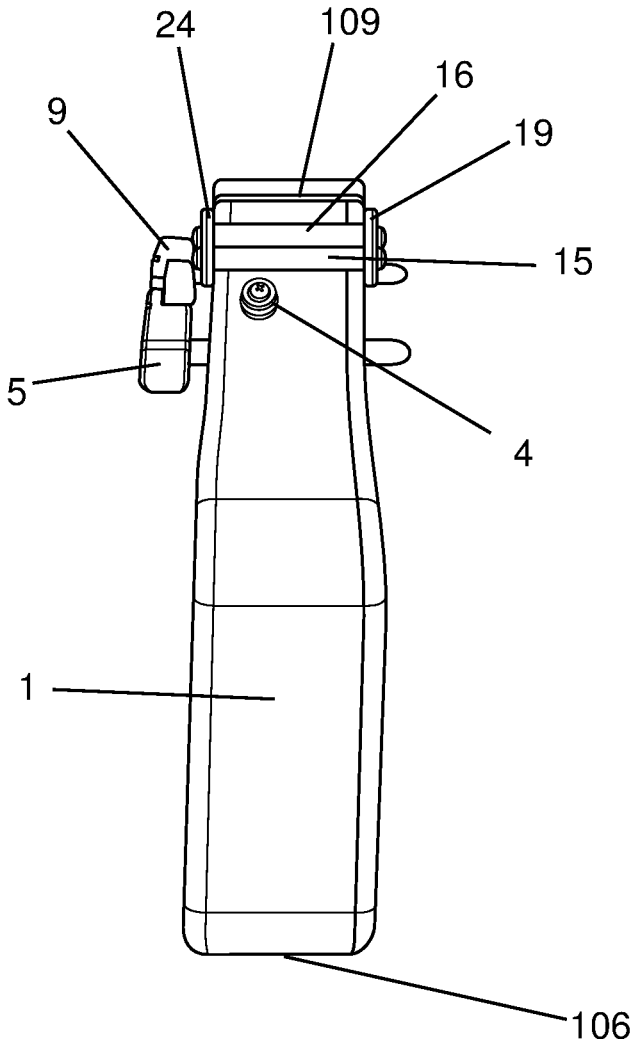
FIG. 6 is a right side view of the invention in a closed or folded position.

FIG. 6 shows the right side view of the preferred embodiment of the present invention in a folded orientation. In this embodiment, the upper-bout frame 1 also referred as the toe 1 is primarily visible as well as the closure of the latch 23 in the latch receiver. FIG. 6 also shows the rod retaining screw knob 4 which tightens and loosens the stabilizer mount 5 and also locks it in the desired position. FIG. 6 also shows the knuckle 106.

Figure 7:
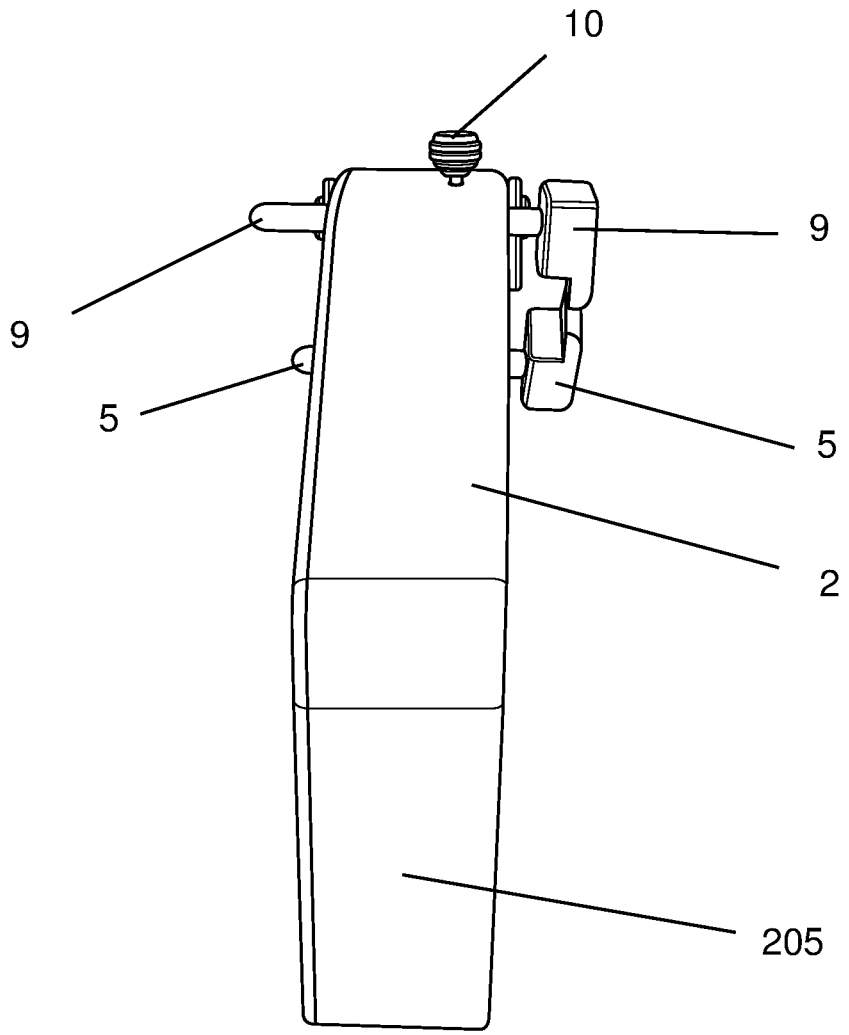
FIG. 7 is a left side view of the invention in a closed or folded position.

The left side view of the preferred embodiment of the present invention in a folded orientation is shown in FIG. 7. The rod retainer screw knob 10 is visible which tightens and loosens the stabilizer mount 9 and also locks it in the desired position. In FIGS. 6 and 7, the stabilizer mounts 5, 9 are shown pushed in, through the frame to protrude on the back side, thereby being secured and ready for travel or storage.

Figure 8:
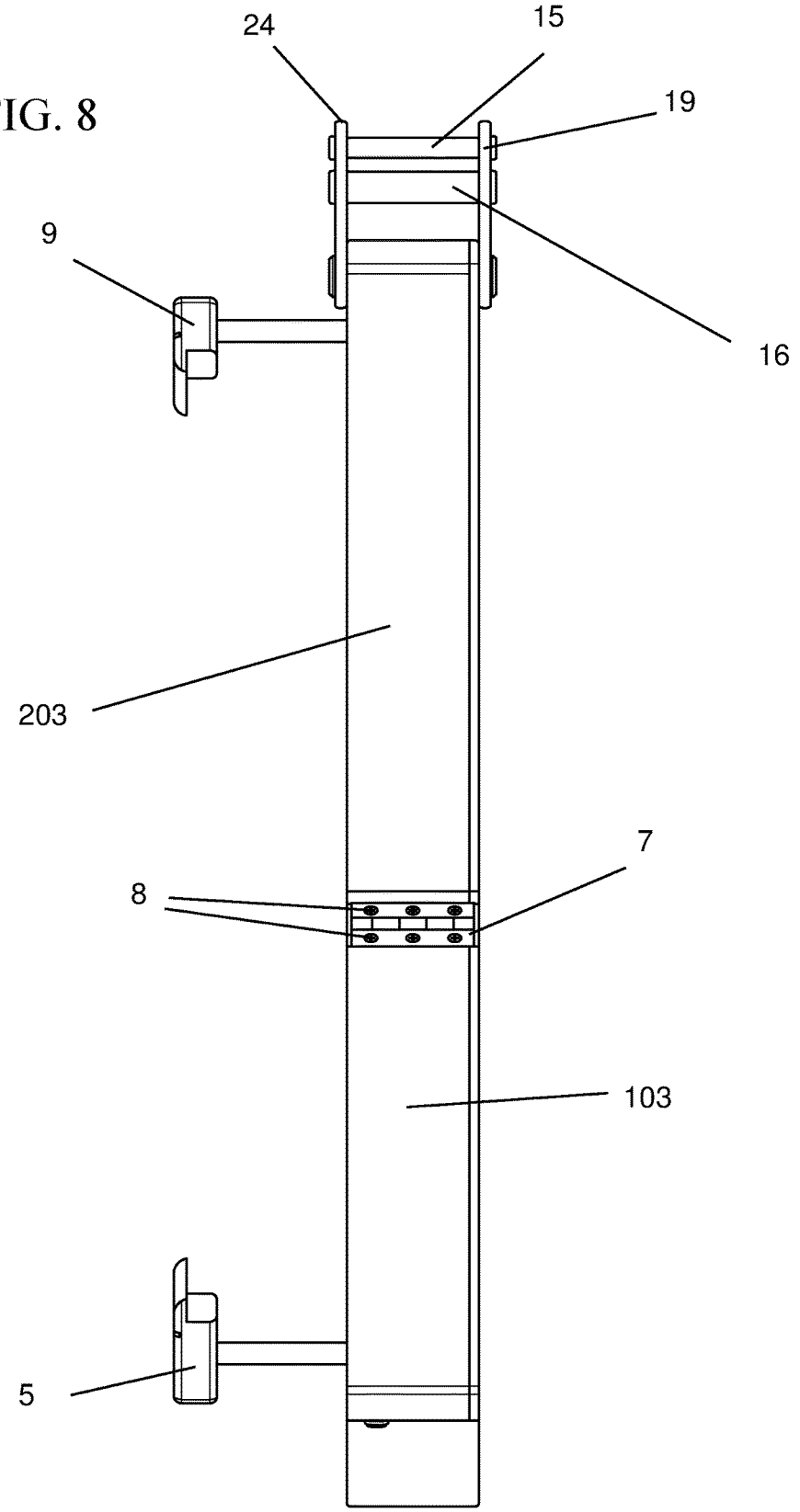
FIG. 8 is a top view of the invention in an open or unfolded position.

The device is once again open for use and the top view of the open device is shown in FIG. 8. This is a similar view that a user may have looking down on the device as it rests on his leg, prior to adding a guitar to the device. Here, the stabilizer mounts 5, 9 are pulled out again and ready to receive a guitar. In FIG. 8, the latch assembly 23 is open. FIG. 8 also shows the hinge 7 used for folding the guitar support into the travel or storage mode. In this embodiment, the hinge is secured to the respective frame portions 1, 2 by attachment screws 8.

In the preferred embodiment, the hinge 7 is not visible to the user because it would be covered by a protective covering, such as felt. The protective covering installed over the top of the finished guitar support frame is for protection of the guitar body. The protective covering is placed on both receiving edges 103, 203, and on the front face of the stops 102, 202 (see FIG. 1), and will wrap off at each end of the frame on the outside and end ¾ inch down each side. Then, the protective covering will tuck into a kerf cut line 109 (see FIG. 6), 209 (see FIGS. 9 and 11) (about 1/16 inch deep grooves) for a finished look. The inside edges of the stabilizer edge mounts 5, 9 are also covered in a protective fabric or covering such as felt. The protective coverings prevent damage to the outside edge of the guitar due to friction generated during play.

Figure 9:
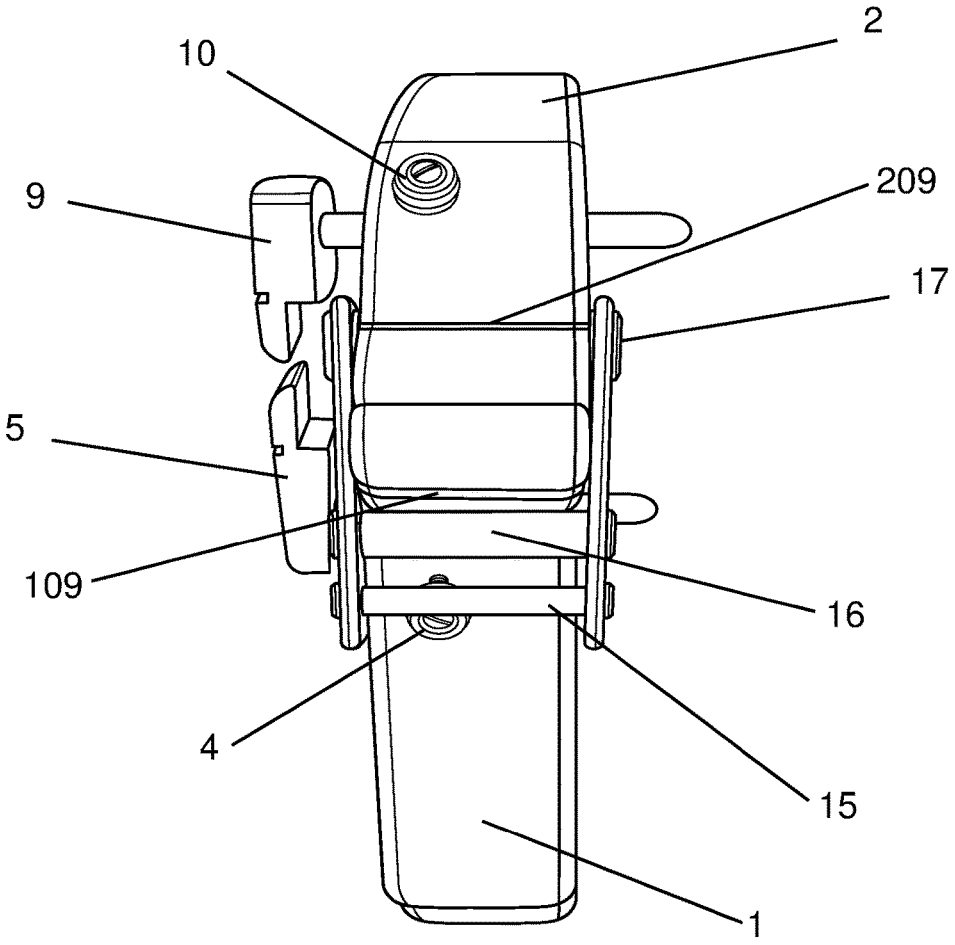
FIG. 9 is a top view of the invention in a closed or folded position.

FIG. 9 shows the top view of a preferred embodiment of the present invention in a folded position (travel or storage mode). The toe 1 and lower-bout support frame 2 of invention are partially visible. The latch roller 16 has been received into the latch receiving notch 104 (shown in FIGS. 1 and 2). The purpose of the latch is securing the invention in a closed position when folded for travel mode. The latch side straps 19, 24 (shown in FIG. 15) have two functions: 1) when the invention is folded, the side straps 19, 24 are the link to securing both halves 1, 2 together; and 2) prevention of any twisting motion of the frame (when folded) that may occur on the folding hinge 7. In FIG. 9 the side straps 19, 24 run parallel to the distal and proximal edges of the toe 1 and lower-bout frame 2. The latch assembly 23 also shows the latch roller 16 and front handle 15. The latch assembly 23 is further shown in an exploded view in FIG. 15. FIG. 9 also shows the stabilizer rod and edge mounts 5, 9 in the pushed in position. The rod retainer screw knobs 4, 10 are for securing rods of the stabilizing mounts 5, 9 in position.

In the preferred embodiment, the guitar support comprises an upper-bout frame/toe, a lower-bout frame, a connecting hinge, two supporting brackets, two stops, a chair abutment point, a leg abutment face, and a latch. The assembly components and hardware of the preferred embodiment of the present invention are shown in the exploded, top perspective view in FIG. 10. The component parts are visible in the various referenced figures and their example dimensions or parameters are described below according to the preferred embodiment.

The toe also called the front frame, or upper-bout receiving support frame 1 has a height of 10 inches, a width of 9⅝ inches, a depth of 2¼ inches, and a thickness of ⅝ inches to 1⅝ inches. A ⅜ inch hole 101 traverses the toe frame for receiving the rod of the stabilizer mount 5.

The toe hole has a second, 7/32 inch hole (not shown) drilled in the right top front end of the frame approximately 2¼ inches down from the top. This hole is drilled for receiving the rod retainer screw knob steel insert 3 for the knob 4 to screw into.

The kerf line 109 (see FIG. 12) is cut into the right side of the toe frame 1 is ¾ inch down the outside and above the latch receiving notch 104. The kerf line 109 is used to retain and end the felt protection covering that runs the length of the device.

Near the bottom left of toe frame 1 is an inlay cut 107 for inlaying the folding hinge 7 (see FIG. 10). The inlay cut 107 sizing is: height ¼ inches, width 2¼ inches, and depth ¾ inches, but can vary depending on the size of the hinge used.

Figure 13:
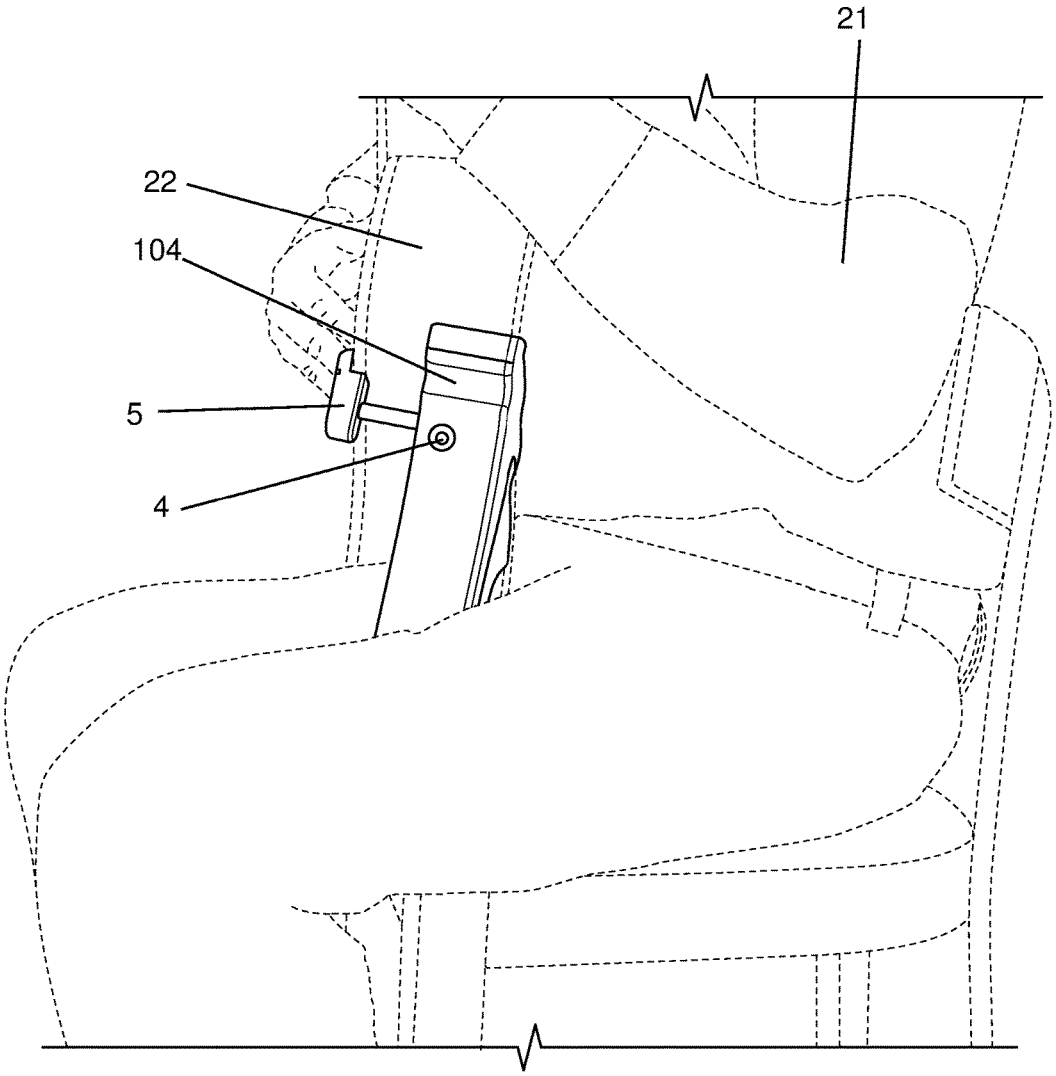
FIG. 13 is an enlarged, right side view of the invention shown during use.

The notch 104 (e.g., shown in FIGS. 1, 2 and 13) secures the latch assembly 23 (see FIGS. 11 and 15), where the latch roller 16 drops over the curve in the side of toe 1 at the junction of the vertically descending support 100 and the upper-bout face 103. In FIGS. 2 and 13, this notch is particularly visible 1⅛ inches down and is a ¾ inch diameter notch 104.

The bottom curve of the leg support 108 (FIG. 12) at the bottom right of the frame is a non-tapered curve that sits on a user's 21 leg or thigh while in use. In the preferred embodiment, this area is covered in ¼ inch thick non-slip neoprene pad (not shown).

The top back side of the toe 1 is the guitar stop or backer plate 102. This stop 102 is for keeping the guitar in place, the guitar cannot go past the back side of the frame that is against the user's torso. The stop size is 3½ inches in length, 3/16 inch thick, and 1 inch in height. The front facing edge of the stop 102 gets covered with felt or protective fabric.

The knuckle 106 is the support structure also called the "Big Heel" (of the "Guitar Shoe"). This knuckle 106 is at the end of a vertically descending support 100 because to adjust the guitar neck elevation the user 21 simply pivots the position of the main frame on the leg. This knuckle 106 provides a primary support location for the guitar on a chair or seat and further allows quick "on the fly" elevation adjustment of the guitar neck. While the device allows neck adjustment, it will only allow it to lower until the knuckle contacts the seat. The knuckle 106 is rounded at the bottom of the support so the user is able to rock himself and the guitar back and forth on the seat, tapping and rocking to the music.

The large, open, center hole 105 (shown in FIGS. 3 and 4) also called a void or cutout of the toe 1 has two primary purposes. One is to serve as a carry handle when the guitar support is folded. The other purpose is to reduce the weight of the device.

The rear main frame, also called the lower-bout receiving support frame 2, has a height of 4½ inches, a maximum length 11⅜ inches, a width 2¼ inches, a thickness ⅝ inch to 1⅝ inches.

The lower-bout receiving support frame 2 continues to be covered by a protective felt covering (not shown) on the top side 203. This felt covering is one piece that runs from the top of the front frame 1. It starts at the right front end (outside ¾ inch down) and goes across the top of the front and rear frame, ending at the left end of the rear frame on outside of frame ¾ inch down where there is a kerf line 209 cut 1/16 inch deep. Felt tucks into this kerf to end and secure the felt. This felt is applied using spray adhesive glue.

The lower-bout receiving support frame 2 has three holes drilled into it. The first hole (not shown) is located on the left end, two inches down from the top. This hole is drilled at 7/32 inch in diameter. A steel insert 11 is driven into the main frame 2 for the rear stabilizer retaining screw knob 10. A second hole 204 is located at the rear end of lower-bout frame ¾ inch from top side of the frame 2. This hole 204 is for the latch assembly. This hole 204 goes through the front side of the frame 2 and comes out the back side of the frame 2. A steel ¼ inch by 2 inches bolt 17 and end cap 18 secure the latch assembly 23 to the rear frame 2. This hole 204 varies in size: inside back of the rear frame—hole size is ¼ inch diameter which runs through the device frame. On the outside front of the frame the hole size is 23/64 inch in diameter. This front of hole 204 is larger to accept the end cap nut 18 for the latch assembly 23. This hole 204 is drilled in about ¾ inch down from the top on the front face of the frame 2. The third hole 201 is located 1¼ inches down the frame 2 and is ⅜ inch in diameter. This hole 201 is drilled through the front side of the frame 2 and comes out the back side. This hole 201 is to receive the rear stabilizer rod and edge mount 9.

There is another guitar stop backer plate (stop) 202 located at the top proximal edge of the lower-bout receiving face 203. This stop 202 is for the guitar's back/bottom edge to rest against so the guitar body cannot go past the frame's inside back. The stop size is length 3¼ inches, height ¾ inch, and thickness 3/16 inch. In the preferred embodiment, both guitar stops 102, 202 are not support pieces but are part of the main frame of the device embodiment.

The stabilizer rod edge mounts 5, 9 slide in and out of the frame 1, 2. When a guitar is received in the device, the stabilizer edge mounts 5, 9 touch the front of the guitar and create a press fit between the edge mounts 5, 9 and the stops 102, 202 to hold the guitar body in place.

A bump out 206 (see FIG. 1) on the bottom of the rear main frame (also called a "small heel") provides stability so the guitar support can stand on its own in an open position when placed on a hard surface. It is useful if the guitar support is not in use and is left unfolded. When the guitar support is set on a surface such as a table, the heel 206 will not allow the main frame to fold back up. It keeps it upright in a ready to use position.

The rear main frame 2 also has a piece of ¼ inch non-slip neoprene pad (not shown) located at the underside 205 for comfort. This pad runs from hinge notch gap cut 207, wraps around the gap cut to the outside of on the underside about 3½ inches long.

With continuing reference to FIG. 10, the inlay cut out 207 creates a space for inlaying the folding hinge 7. Located at the end of the rear frame, the inlay cut 207 has a height of ¼ inch, a width 2¼ inches, and a depth ¾ inch.

Two hex drive wood inserts 3, 11 are inserted into the respective ends of the device. Each 8-32 mm steel hex drive wood insert is driven into the frame 1, 2 to give the respective rod retainer screw knobs thread so that each can be installed into the frame 1, 2. Then two, rod retainer screw knobs 4, 10 are made from a solid wood knob that is drilled out for a #8-32 mm brass screw. The knob screw 4 received into the toe 1 is ⅞ inch long. The knob screw 10 that is received into the lower-bout frame 2 is ⅜ inch long. Screw heads are counter sunk into the wood knob and glued in place. The insert steel hex drive wood inserts 3, 11 are the same sizes. Finally, the rod stabilizer rods and edge mounts 5, 9 are added.

With reference to all of the drawings, additional components, details of materials, and dimensions of the preferred embodiment are as follows:

The first stabilizer rod and edge mount 5 received into the toe 1 is made from two pieces of hardwood with a total length of 4⅛ inches, a width of 2¼ inches, and a thickness of ¾ inch.

The dowel rod for the stabilizer mount 5, 9 has a ⅜ inch diameter. The inside edge of the mount pad is ½ inch wide by ¾ inch with a ¾ inch upright lip. These mounts are custom made for the guitar support. The dowel rods are glued into the edge mount to complete the stabilizer mounts 5, 9. Felt is glued to the interior of the mount edge.

The second stabilizer rod and edge mount 9 that is received into the lower-bout frame 2 has the same dimensions as the first stabilizer rod and edge mount 5 except the mount 9 is 4 inches in length (⅛ inch shorter) and the mount itself is only 1¾ inches wide, instead of 2¼ inches. This is so the rear mount 9 can clear the latch assembly 23.

The purpose of the stabilizer rod and mount pads is to stabilize the front outside edge of a guitar. The frame 1, 2 of the invention only touches the first 2 inches of the width of the guitar, see FIGS. 11-13. The faces 103, 203 support the back bottom edge of the guitar. The stabilizing mounts 5, 9 keep the guitar from tipping out, but they do not attach. The guitar body rests against the bottom inside edge of the main frame and the mount pads touch the front side of the guitar body.

The gap filler screws 6 also called Guitar Shoe frame adjustment screws are size #8, 1¼ inches. Guitar bodies vary in size. These adjustment screws allow space adjustment between the two frames 1, 2 for proper fit when guitars of various sizes are installed into the guitar support frame for use. The gap filler screws 6 are received into the holes 208 at the abutment point of the toe 1 and lower-bout frame 2. These holes are visible in FIG. 10. Turning the screws out will separate the two frames just slightly (narrow the angle of the guitar receiving faces) to accommodate a slightly smaller bodied guitar, while turning the screws in will allow the frames to open fully to accept a slightly larger bodied guitar.

The hinge 7 is a metal hinge 1⅜ inch by two inches in size. Six mounting hinge screws 8 secure the hinge 7 to the frame pieces. The hinge allows the guitar support to fold. The hinge 7 is glued and screwed to frame pieces. The hinge screws are size: #6, ½ inch.

Figure 15:
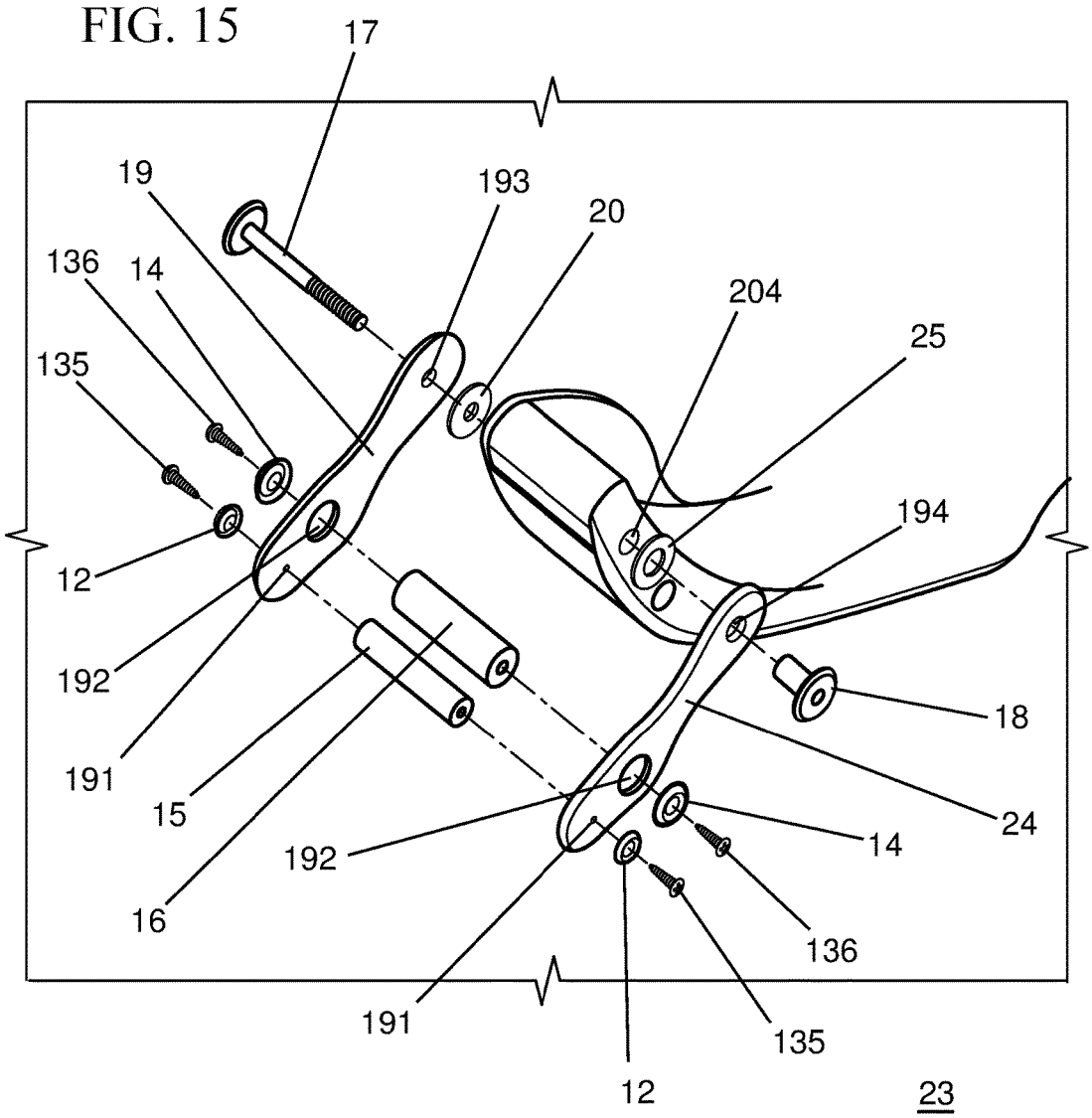
FIG. 15 is an enlarged, exploded view of the latch assembly.

FIG. 15 has been enlarged to more clearly show the exploded latch assembly 23 of the preferred embodiment of the present invention. The latch includes two #8 brass finish washers 12. Used as a finish accent, one washer 12 is provided for each side of the latch side straps 19, 24 for a total of two washers. Latch and roller handle screws 13 are size: #6—½ inch wood screws. Four total screws are provided, two 136 are for holding the latch roller 16 in place and two 135 are used for securing the latch handle 15 in place. A #10 brass finish washer 14 is used to keep the latch roller 16 in place. One washer is provided for each side of latch side straps 19, 24. The latch handle 15 has a size 5/16 inch diameter and is 2 3/16 inch long. It is comprised of a hardwood dowel. The latch handle 15 is used to open and close the latch 23. The latch roller 16 has a ½ inch diameter and is 2⅜ inches long. It is also a hardwood dowel. This roller 16 is how the latch 23 is able to lock in and out of the guitar support frame and secure the guitar support in closed position after being folded. The latch roller 16 slides in and out of the ¾ inch notch 104 that is cut into the right side of the toe 1 near the top, ⅜ inch down from felt kerf cut 109. A connector bolt 17 (size: ¼ inch diameter by 2⅜ inches long steel bolt) is used to connect latch assembly 23 to the guitar support frame 2 and allows the latch 23 to move freely on the guitar support frame. A cap nut 18 (Size: 23/64 inch diameter by ¾ inch long steel cap nut) is used to secure the connector bolt 17 that runs through guitar support frame 2.

The latch 23 has two side straps: a left/back side 19 and a right/front side 24. The shapes of each side strap 19, 24 are mirror images of one another but with a different sized hole. The hardware is ⅞ inch by 3½ inches (shown in FIGS. 3 and 4) and is made of hardwood and custom designed. These side straps 19, 24 are the frame of the latch 23. Three holes are drilled into each side strap piece 19, 24.

The front side strap 24 hole sizes are as follows: 23/64 inch diameter cap nut hole 194 drilled ¾ inch in from end of strap. From there, a 31/64 inch diameter hole 192 is drilled 1⅞ inches from the cap nut hole 194. This hole 192 is for the latch roller 16 to slide through side straps 19. This allows roller 16 to spin freely. From there, the third hole 191, a 1/16 inch diameter hole is drilled 5/8 inch from the roller hole 192. This handle hole 191 is to secure the latch handle 15 to side straps 19, 24.

The back side latch side strap 19 has the same diameter handle hole 191 and roller hole 192 however it has a smaller hole to receive the connector bolt 17, the connector bolt hole 193 is drilled at 1/4 inch diameter.

Two nylon washers 20, 25 aid in the free movement of the latch 23. They also keep the latch from rubbing the finish off the guitar support frame. The washers 20, 25 are 1/2 inch nylon washers. The front washer (25) is drilled 31/64 inch hole for cap nut 18. The back washer (20) is a drilled 1/4 inch hole to receive the connector bolt 17. These washers (one on each side) fit between the latch side straps 19, 24 and the end of the lower-bout support frame 2.

Figure 11:
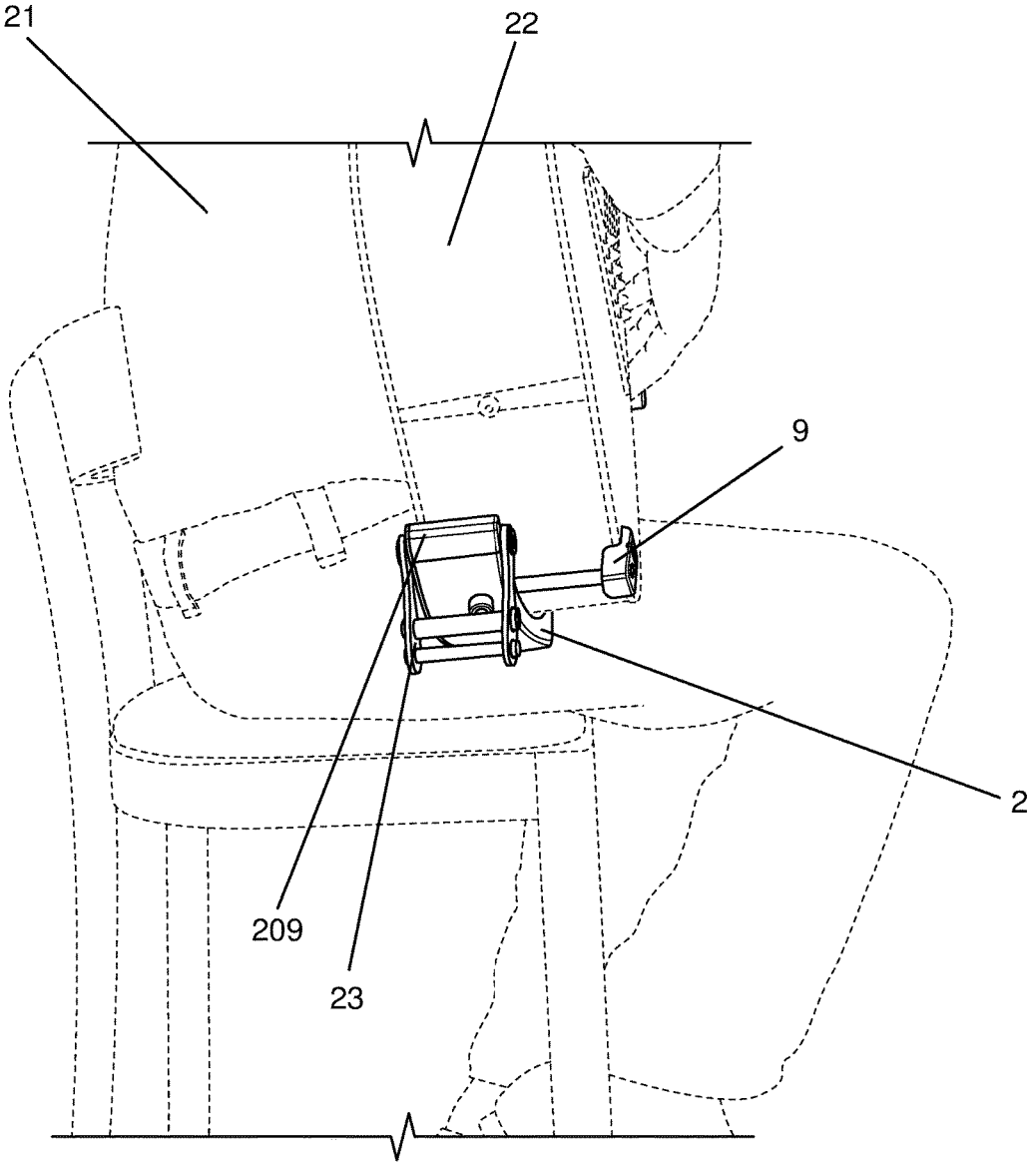
FIG. 11 is an enlarged, left side view of the invention shown during use.

Turning to FIG. 11, the guitar support is shown with a guitar 22 in place and in use by a user 21. The rear end 2 of guitar support and the tail end of guitar body 22 are visible as is the latch assembly 23 which is in an open and neutral position, swung down. The rear stabilizer rod and edge mount 9 is visible and in use pressing the guitar on the guitar support. The mount 9 is not clamping the guitar, but rather the outer edge of the guitar body is resting on the edge mount and the stabilizer rod is adjusted so that the mount's upper part of the pad just touches the outside of the bottom of the guitar. This stabilizes the guitar while in use but does not put unnecessary force on the guitar body, which may damage the guitar. The kerf line 209 is cut into lower frame 2 and visible 3/4 inch down on the side. The kerf line is used to retain and end the felt protection covering that runs the length of the receiving edge 103, 203 of the two parts of the main frame 1, 2.

FIG. 13 is a right side view of guitar support in use. The preferred embodiment of the preferred invention is shown resting on a user's right leg thigh as it would be used by a right handed player. The front stabilizer rod and edge mount 5 is shown in the playing position just touching the outside edge of guitar 22. FIG. 13 shows the front rod retainer screw knob 4. Just above the knob 4 is the latch's void cut out or receiving notch 104 for the latch roller 16 to lock into for storage or travel mode. Just above that notch 104 is the protected felt kerf cut line 109 (see FIG. 12) which helps secure felt for a finished look. The upper portion of the back side of the guitar support may touch the user's stomach during use while the lower portion of the guitar abuts the stops 102, 202.

Figure 12:
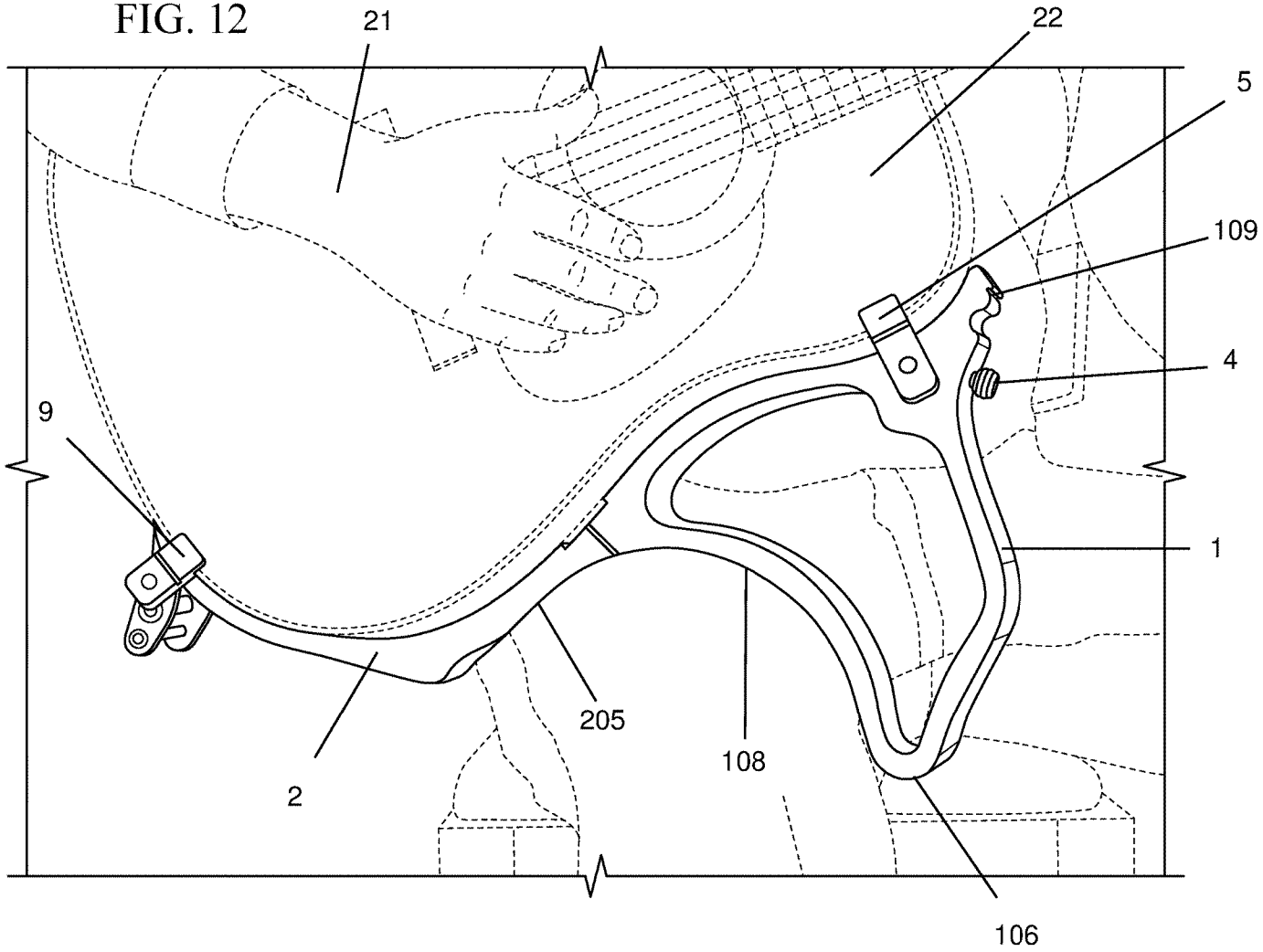
FIG. 12 is an enlarged, front view of the invention shown during use.

With reference to FIG. 12, a close-up view of the guitar 22 and the guitar support are shown on a user's lap during use. The guitar is sitting in the guitar support. In this enlarged front view of the guitar support in use, the stabilizing mounts 5, 9 are engaged to fit the guitar. To actuate the mounts, the stabilizer rod retaining knobs 4, 10 are loosened. The mounts 5, 9 are pulled out to position, and the mounts are turned up to catch outer edge of guitar. The mounts will work while barely touching the guitar. The retainer knobs 4, 10 are tightened to hold the stabilizer mounts in place. The guitar support is designed to sit on the right leg thigh of a right-handed user 21. The guitar support can also be made for a left hand user by simply making a mirror image of the present design so the backer plate tabs or stop 102, 202 would appear on the opposite face, or the opposite side of the receiving face 103, 203 and the stabilizer mounts 5, 9 would be received on the opposite side. In FIG. 12, the knuckle 106 or Big Heel of the guitar support is visibly resting on the user's chair. This is the lowest elevation point to which the user 21 can drop the neck of the guitar 22. The user 21 can lower the guitar neck elevation by pivoting the guitar support on the knuckle 106. The user can raise the neck elevation by simply pivoting the guitar support to the outside of the thigh by putting down pressure on the strumming arm, therefore raising the guitar neck's elevation. This can be done while playing the guitar, allowing the user 21 to adjust neck elevation on the fly.

When the knuckle 106 is touching the chair or other surface upon which the user is sitting, it adds great back support for the user 21 when the guitar is being played. This support discourages hunching and relieves back pain associated with long hours of play by the user 21. Hunching over the guitar restricts the user's diaphragm which can be a problem if the user is playing guitar and singing while in a seated position. All too often, a seated player will begin to hunch over the guitar and when they sing in that hunched position, they are not able to draw in as much air to their lungs because of the restriction to their diaphragm.

Figure 14:
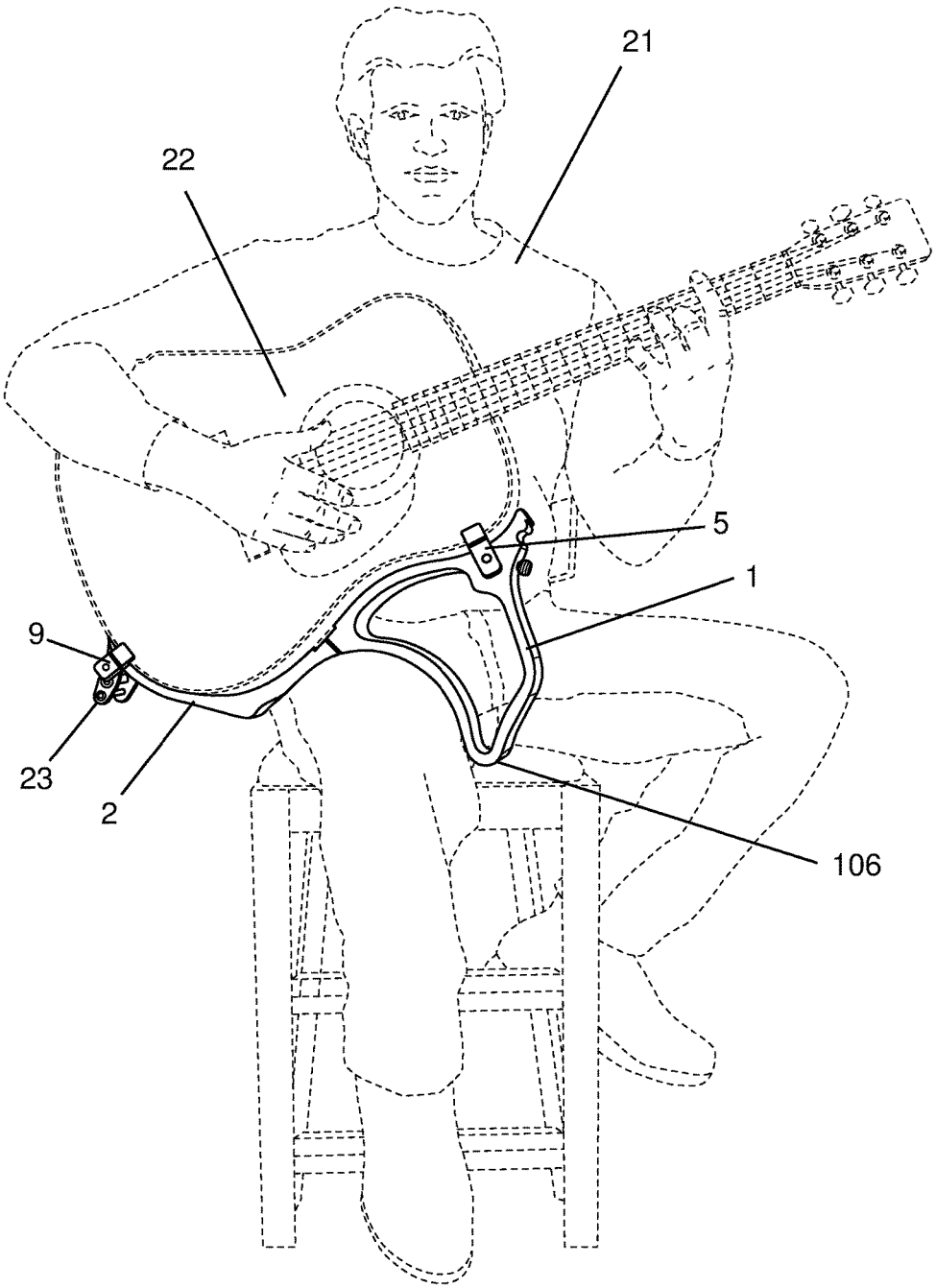
FIG. 14 is a front view of the invention show during use.

Similar to FIG. 12, FIG. 14 is a front view of the guitar in use but illustrates the full body of the user on a chair and the proper posture used. The guitar support will be noticed sitting on the user's leg thigh. To change guitar neck elevation on the fly, the user simply pivots the guitar support by exerting down pressure on the strumming arm which pivots the support to the outside of the thigh, raising the guitar neck. Conversely, letting off pressure of the strumming arm pivots the support to the inside of the thigh lowering the neck. This is a big advantage when a user needs to make adjustments while playing. It is quick and easy and does not interfere with playing. A user may adjust several times just in one song as he moves to the song's rhythm and beat, or reaches or compresses to hit a particular chord. This ability is important to the present invention.

The guitar support will be preferably constructed of wood, plastic or polymers. Recycled materials such as recycled plastic material could potentially be used. The preferred wood is not recycled, but it is a renewable resource. Retrofitting aspects of the invention may be possible, but those retrofits must work as well as original components because each part/component of the guitar support has a specific purpose. Both front and rear frame pieces have a neoprene, or similar material pad, installed on the leg rest and underside of the frame. Both pieces end at the hinge spine gap. The reason for this is to give the two halves some spring tension when the guitar support is unfolded. Guitars vary in size a little; no two are exactly the same. Therefore, the neoprene creates a little give when a guitar is installed into the guitar support frame. In the preferred embodiment both main frames (front 1 and rear 2) are made out of sheeted plywood. Three pieces of 3/4 inch plywood and one piece of 3/16 inch plywood are glued together to create a 2 1/4 inch thick piece. There are no fasteners. Plywood is preferred because it is strong, stable, lightweight and inexpensive.

All parts of the guitar support which touch the guitar body are wrapped in a protective covering. One material used to protect the guitar body may be felt. If the particular components are not constructed of a material such as silicon or soft plastic, then the protective material should certainly cover the inside edge of the mount (the part that touches the guitar body) and around the top going to the outside front of the mount and edge are wrapped in a protective felt covering with a kerf line cut on the outside front of the mount to end and secure the felt.

The overall dimension of the folded guitar support, in the preferred embodiment, when it is assembled are as follows:

height 11 inches which includes the knob; length 12 inches; width 4¼ inches with the rods pushed in; depth/thickness ⅝ inch to 1⅝ inches and comprising an overall oblong shape.

The overall dimension of the unfolded guitar support, in the preferred embodiment after it is completely assembled are as follows: height 11½ inches; length 20½ inches; width 4¼ inches with the rods pushed in; depth/thickness of an inch to 1 inch and the overall shape is still oblong.

It is further intended that any other embodiments of the present invention which result from any changes in application or method of use or operation, method of manufacture, shape, size, or material which are not specified within the detailed written description or illustrations contained herein yet are considered apparent or obvious to one skilled in the art are within the scope of the present invention.

I claim:

1. A device for use with an instrument having an upper-bout and a lower-bout, the device comprising:

a toe, the toe having an upper-bout receiving face, a vertically descending structure, a chair abutment knuckle, and a leg rest, the upper-bout receiving face is adjacent to the vertically descending structure, the vertically descending structure meets the leg rest at the chair abutment knuckle, the upper-bout receiving face having a first proximal projection, a lower-bout receiving support frame affixed to the toe at a junction of the leg rest and the upper-bout receiving face, the lower-bout receiving support frame having a lower-bout receiving face shaped to receive the lower-bout, the lower-bout receiving face having a second proximal projection, at least one stabilizer bracket the stabilizer bracket adjustably adjoined to the toe, the stabilizer bracket pressing the instrument against the first proximal projection.

2. The device of claim 1 wherein a first stabilizer secures the instrument against the first proximal projection and a second stabilizer bracket secures the instrument against the second proximal projection.

3. The device of claim 1 wherein an interior center cutout traverses the toe.

4. The device of claim 1 wherein a second stabilizer bracket is adjustably adjoined to the lower-bout receiving support frame.

5. The device of claim 4 wherein the stabilizer brackets are secured to the device by screws.

6. The device of claim 1 wherein the lower-bout receiving support frame further comprises an underside shaped to adjoin and complement the leg rest of the toe.

7. The device of claim 6 wherein the underside further comprises a heel.

8. The device of claim 1 wherein the lower-bout receiving frame is affixed to the toe by a hinge.

9. The device of claim 8 wherein the lower-bout receiving frame folds toward the upper-bout receiving face about the hinge.

10. The device of claim 9 wherein the lower-bout receiving frame further comprises a latch.

11. The device of claim 10 wherein the toe further comprises a latch receiver.

12. The device of claim 8 wherein the hinge is adjustable to varying opening angles by adjustment screws narrowing an angle of abutment between a first hinge face and a second hinge face.

13. A folding device for use in supporting an instrument having an upper-bout and a lower-bout, the device comprising:

a toe, the toe having an upper-bout receiving face, a vertically descending structure, a chair abutment knuckle, and a leg rest, the upper-bout receiving face is adjacent to the vertically descending structure, the vertically descending structure meets the leg rest at the chair abutment knuckle, the upper-bout receiving face having a first proximal stop, a lower-bout receiving support frame hingedly affixed to the toe at a junction of the leg rest and the upper-bout receiving face, the lower-bout receiving support frame having a lower-bout receiving face shaped to receive a lower-bout of the instrument, during use the instrument rests on the upper-bout receiving face and the lower-bout receiving face and at least one instrument stabilizer bracket adjustably adjoined to the toe presses the instrument against the first proximal stop, the brackets are loosened to push in stabilizer rods after use and the lower-bout receiving frame folds toward the upper-bout receiving face, a latch secures the lower-bout receiving support frame to a latch receiver on the toe.

14. The folding device of claim 13 wherein a second stabilizer bracket adjustably adjoined to the lower-bout receiving support frame presses the guitar against a second proximal stop of the lower-bout receiving face.

15. The folding device of claim 13 wherein a center cutout traverses the toe.

16. The folding device of claim 13 wherein the lower-bout receiving support frame further comprises an underside shaped to adjoin and complement the leg rest of the toe.

17. The folding device of claim 16 wherein the underside further comprises a heel.

18. A folding device for use with a guitar having an upper-bout and a lower-bout, the device comprising:

a toe, the toe having an upper-bout receiving face, a vertically descending structure, a chair abutment knuckle, and a leg rest, the upper-bout receiving face is adjacent to the vertically descending structure, the vertically descending structure meets the leg rest at the chair abutment knuckle, the upper-bout receiving face having a first proximal stop, the distal edge of the upper-bout receiving face having a stabilizer mount adjustably retaining the guitar, a lower-bout receiving support frame comprising a lower-bout receiving face shaped to receive the lower-bout of a guitar, and further comprises an underside shaped to adjoin and complement the leg rest of the toe, the lower-bout receiving face having a second proximal stop, a hinged joint located between the toe and the lower-bout receiving support frame, during use the guitar rests on the upper-bout receiving face and the lower-bout receiving face and at least one guitar stabilizer bracket adjustably adjoined to the toe presses the guitar against the first proximal stop, a second stabilizer bracket located in the lower-bout receiving support frame presses the guitar against a second proximal stop of the lower-bout receiving face, after use the brackets are loosened to push in for travel or storage mode, and the lower-bout receiving frame folds toward the upper-bout receiving face until a latch engages a latch receiver and secures the device in a folded position.

19. The folding device of claim 18 wherein at least one adjustable, gap insert is located in the hinged joint.

20. The folding device of claim 18 wherein the toe further comprises an interior center void.

21. The folding device of claim 18 wherein the underside further comprises a heel.

* * * * *